US006359205B1

(12) United States Patent
Lombardi

(10) Patent No.: US 6,359,205 B1
(45) Date of Patent: Mar. 19, 2002

(54) DRUM PEDAL UNIT PEDAL POSITION ADJUSTMENT

(75) Inventor: Donald G. Lombardi, Thousand Oaks, CA (US)

(73) Assignee: Drum Workshop, Inc., Oxnard, CA (US)

( * ) Notice: Subject to any disclaimer, the term of this patent is extended or adjusted under 35 U.S.C. 154(b) by 0 days.

(21) Appl. No.: 09/732,536

(22) Filed: Dec. 11, 2000

(51) Int. Cl.[7] ..... G10D 13/02
(52) U.S. Cl. ..... 84/422.1; 84/422.2; 84/422.3
(58) Field of Search ..... 84/422.1, 422.2, 84/422.3

(56) References Cited

U.S. PATENT DOCUMENTS 1,042,919 A * 10/1912 Hughes ..... 84/422.2
2,800,828 A 7/1957 Moeller
3,930,431 A 1/1976 Magadini
4,134,325 A * 1/1979 Loftus ..... 84/422.1
4,188,853 A 2/1980 Bills
4,691,613 A * 9/1987 Jacobson ..... 84/422.1
5,646,360 A * 7/1997 Lias ..... 84/422.1
5,767,428 A * 6/1998 Block ..... 84/422.1
D402,683 S 12/1998 Brewster et al.

* cited by examiner

*Primary Examiner*—Shih-Yung Hsieh
(74) *Attorney, Agent, or Firm*—William W. Haefliger

(57) ABSTRACT

An adjustable pedal unit, for beating a drum, comprising a base; a pedal having rearward connection to the base, at a heel region, to accommodate pedal pivoting; a pedestal unit carried by the base and spaced forwardly of rearward connection, and a drum beater carried by the pedestal unit to be rotated in response to foot actuated pivoting of the pedal; and there being an adjustment on the base whereby the relative positioning as between the pedestal and the pedal can be selectively adjusted.

29 Claims, 5 Drawing Sheets

FIG. 5.
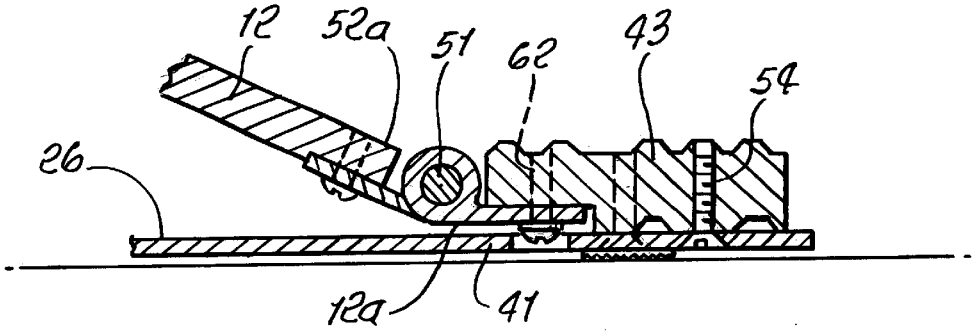
FIG. 6.
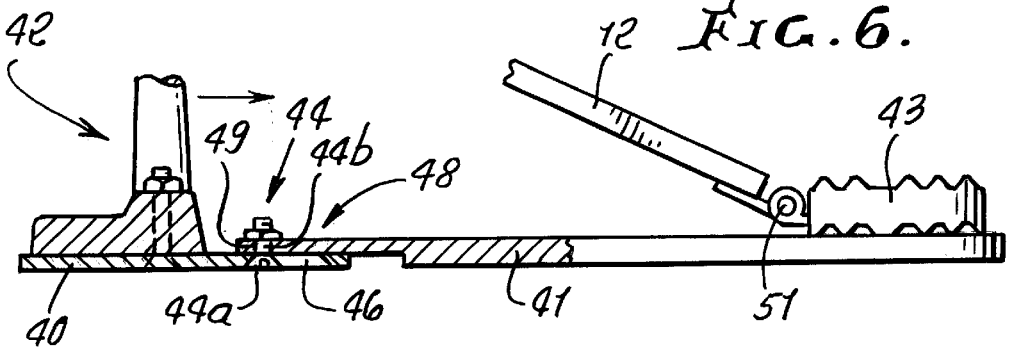
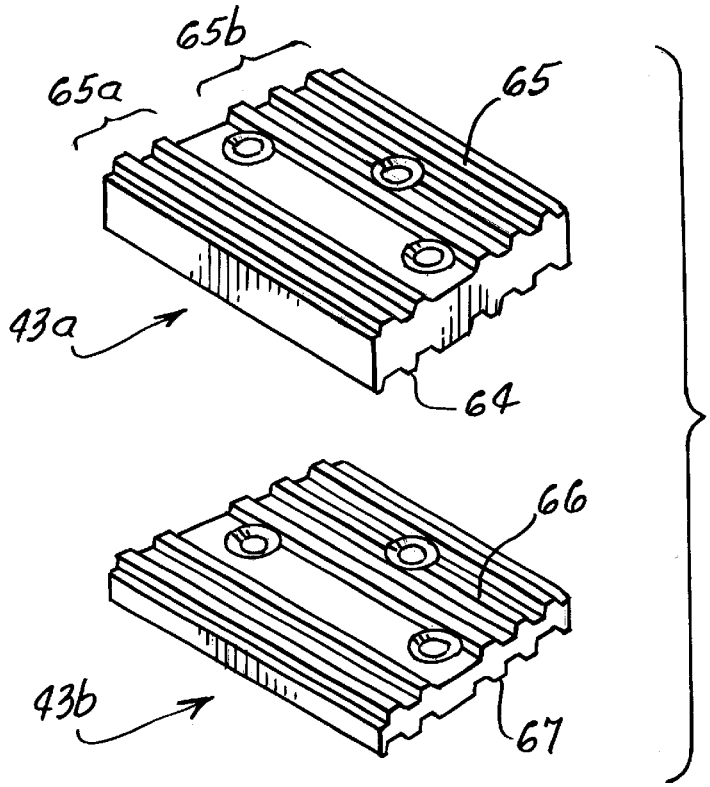
FIG. 7.

DRUM PEDAL UNIT PEDAL POSITION ADJUSTMENT

BACKGROUND OF THE INVENTION

This invention relates generally to drum beating apparatus, and more particularly to adjustment of such apparatus to selectively locate the foot pedal in relation to the beater being rotatably actuated.

Pedal units for rotatably rotating drum beaters or mallets typically include the following elements:

a) a base, b) a pedal having rearward connection to the base, at a heel region, to accommodate pedal pivoting, c) a pedestal unit carried by the base and spaced forwardly of said rearward connection, and a drum beater carried by the pedestal unit to be rotated in response to foot actuated pivoting of the pedal, Considering the substantially different sizes of drummer's shoes, there is need to accommodate such pedal units to such different shoe sizes, for comfort of the drummer. There is also need to achieve forward and rearward adjustment and/or pedal heel height adjustment, in order to achieve such desired accommodations, and also to adjust the angularity of the pedal relative to the base, for ease of foot actuation of the pedal.

SUMMARY OF THE INVENTION

It is a major object of the invention to provide adjustment apparatus and/or components to provide such desired accommodation in one or both of the modes referred to. Basically, the adjustable pedal unit of the invention includes, in combination with the above referenced elements, an adjustment on the base whereby the relative positioning as between the pedestal and the pedal can be selectively adjusted. As will be seen, such adjustment is preferably located forward of the pedal connection to the base, that connection typically being provided by a heel plate. Accordingly, that connection is not disturbed by such selective adjustment.

Another object is to provide the base to have two associated sections which are relatively movable, and wherein said adjustment is between said two sections. At least one fastener may be provided to extend in a slot in at least one of the base sections; and the base sections may extend in overlapping relation, spaced from the heel plate, whereby the fasteners may be adjusted to effect clamp together of the two sections in selectively adjusted positions.

As an alternative, the adjustment may be located between the pedestal unit and the base, and may include elements associated with the pedestal unit and the base. Such elements may include openings such as slots on at least one of the pedestal unit and the base, to receive a fastener or fasteners that clamp together the pedestal unit and base in selectively adjusted position.

A further object includes provision of a height adjustment to adjust the height of pedal rearward extent relative to the base. Such height adjustment preferably includes at least one removable plate positioned in stacked relation with a heel plate at the rearwardmost extent of the pedal. In this regard, the pedal may include forward and rearward sections, and the removable plate may be located between the base and the pedal rearward section. That section may itself comprise a heel plate to which the pedal forward section is pivotably connected to allow up and down pivoting of the pedal by the drummer's foot or shoe. At least one removable fastener may be provided to attach the removable height adjustment plate between the pedal heel plate and the base.

A yet further object is to provide at least two relatively superimposed and removable plates positioned at locations proximate the base and said pedal rearward section. Such plates, and the heel plate, may have undulant interengagement surfaces to positively position them against sliding; and the various plates may have different thicknesses, permitting their selective use to achieve different pedal heel height selective adjustments.

The heel height adjustment or adjustments as described may be combined with the forward and rearward adjustment earlier referred to in order to very simply achieve a measure of universal adjustment, in the same pedal unit.

These and other objects and advantages of the invention, as well as the details of an illustrative embodiment, will be more fully understood from the following specification and drawings, in which:

DRAWING DESCRIPTION

FIG. 5 is an enlarged section taken in elevation to show fastener connection of a pedal heel pad or plate to a base plate;

FIG. 6 is an elevation showing the FIG. 5 base plate, and pedal, the base plate having sections that are relatively adjustable, forwardly and rearwardly, the pedestal carried on one section and the pedal heel pad or plate carried by the other section;

FIG. 7 is a perspective view showing two additional plates one or both of which can be employed for pedal heel end height adjustment.

DETAILED DESCRIPTION

Figure 1:
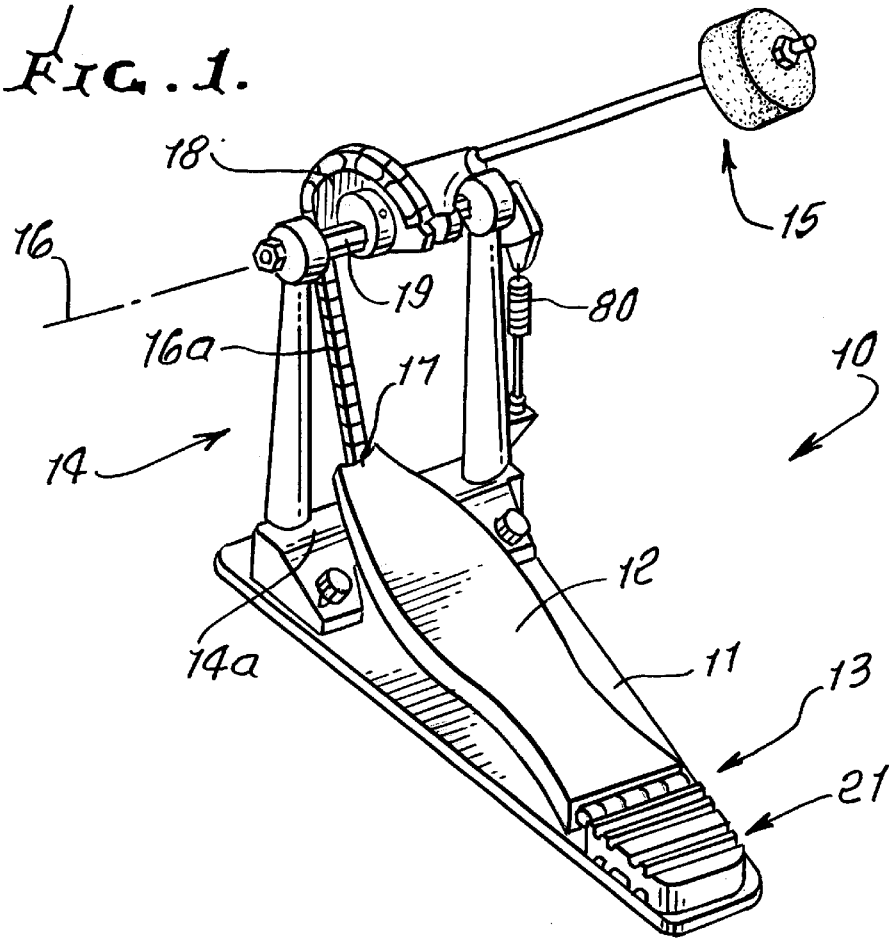
FIG. 1 is a perspective view of a pedal unit.

In FIG. 1, the pedal unit 10, for beating a drum, includes a base 11 in the form of a plate or plate sections; a pedal 12 having rearward connection to the base, as at a heel region 13, to accommodate up and down pivoting of the pedal; and a pedestal unit 14 carried by the base and spaced forwardly of the region 13. A drum beater, such as a mallet 15, is carried by the pedestal unit to be rotated as about horizontal axis 16, in response to drummer's foot activated pivoting of the pedal 12. For example, a flexible linkage such as a chain 16*a* is typically connected to the forward portion of the pedal, as at 17, and is also connected to a rotor 18 carried by an axle 19 of the pedestal unit, to rotate the rotor, and the beater 15, in response to downward pivoting of the pedal, return spring 80 yieldably resisting such rotation.

Figure 2:
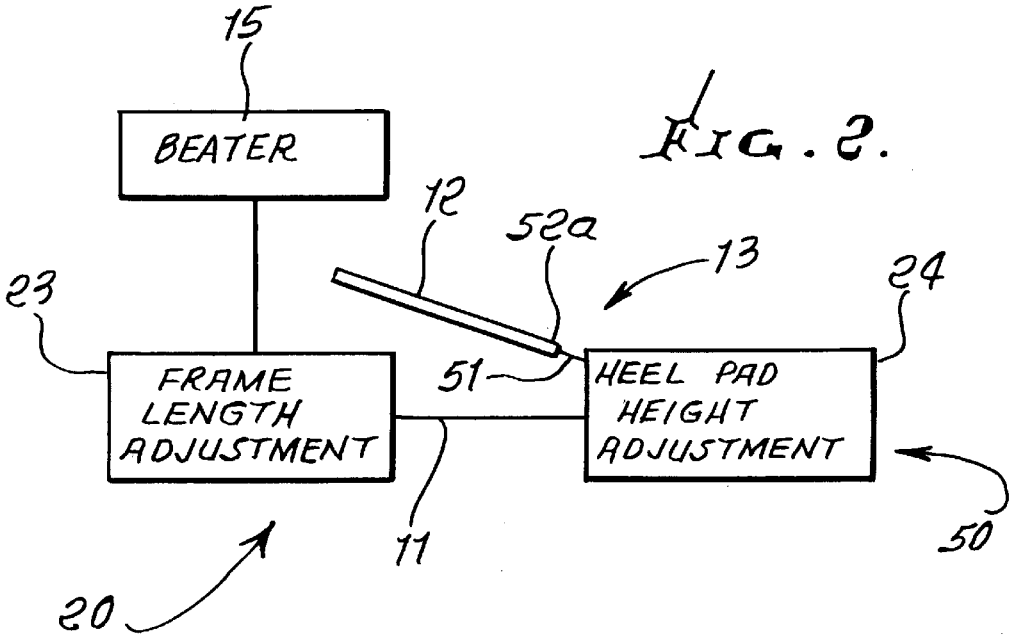
FIG. 2 is a system block diagram.

In the above environment the invention preferably includes an adjustment (see 20 in FIG. 2) on the base whereby the relative positioning as between the pedestal and the pedal can be selectively adjusted; and/or, a height adjustment at the heel pad zone 21 whereby the pedal height, particularly at the heel pad zone, can be selectively adjusted. These two selection adjustments are indicated generally in FIG. 2, as at 23 and 24.

Figure 4:
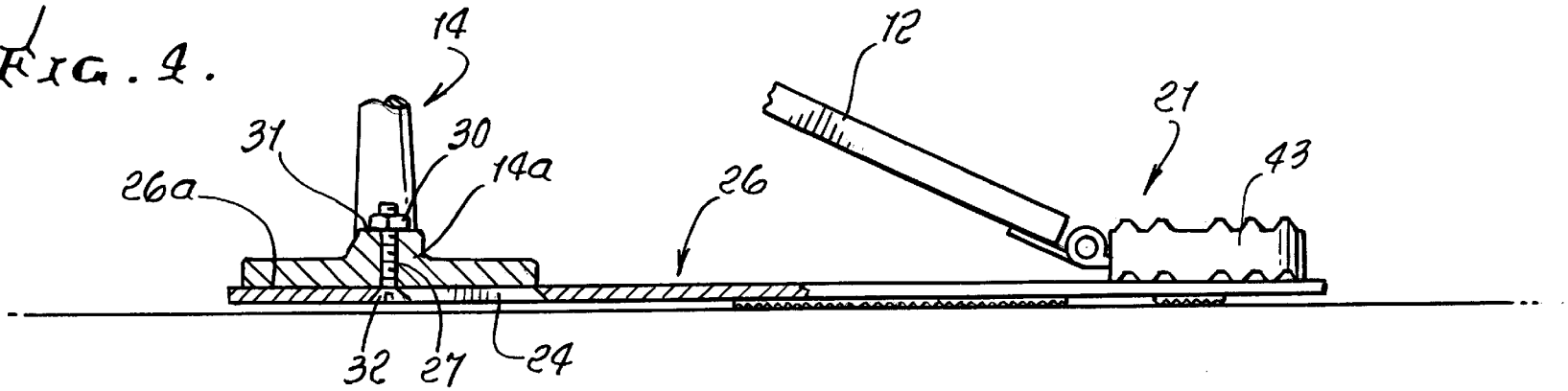
FIG. 4 is a section taken in elevation on lines 4—4 of FIG. 3.
Figure 3:
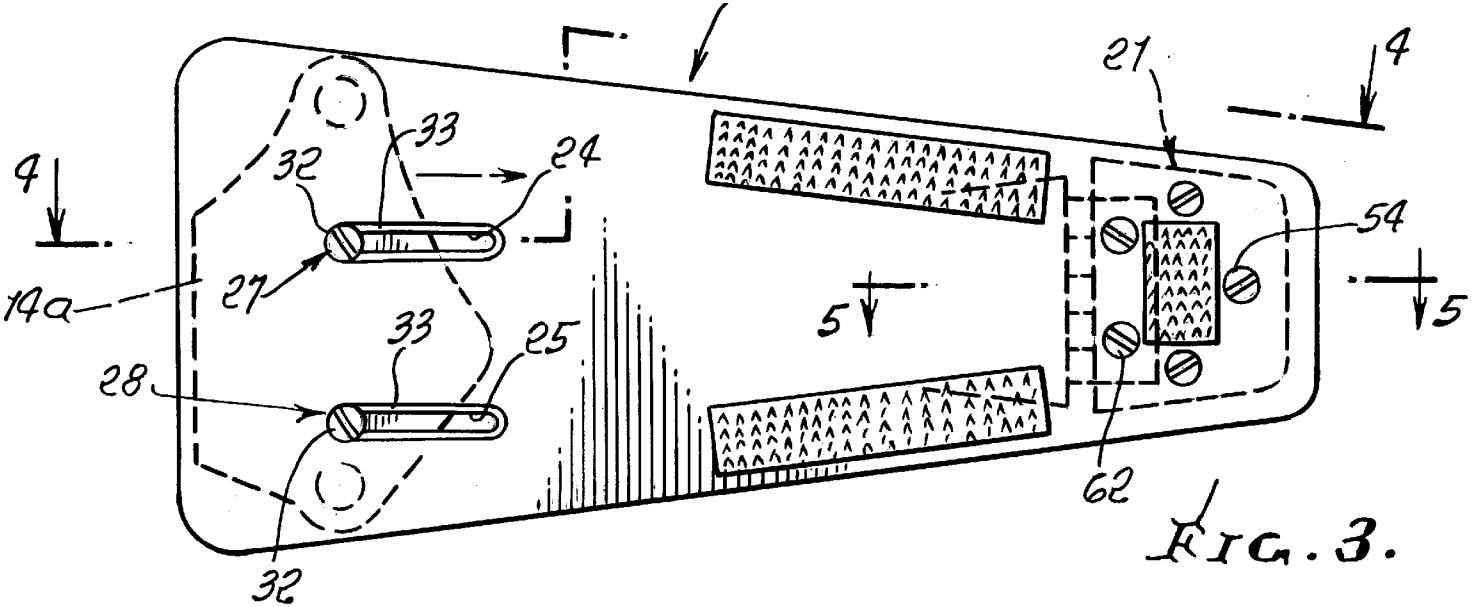
FIG. 3 is a bottom plan view of a base plate configured for relative forward and rearward adjustment as between a pedestal unit and the plate.

One way of providing the first mentioned adjustment, on the base, is shown in FIGS. 3 and 4. Such adjustment includes elements associated with the pedestal unit and the base, said elements providing an adjustable connection. See for example openings on one of the pedestal unit and base, as for example openings such as slots 24 and 25 in the base plate 26; and fasteners carried by the other of the pedestal unit and base, as for example fasteners 27 and 28 carried by the lower extent 14*a* of the pedestal unit and projecting into the openings or slots 24 and 25, respectively. Upon loosening of the fasteners, the pedestal 14 can be bodily adjustably shifted toward or away from the pedal heel pad zone 21; thereafter, the fasteners can be tightened to clamp the pedestal unit to the top 26*a* of the plate 26, as seen in FIG. 4. Note nut 30 on the fastener tightened against the pedestal top shoulder 31, and fastener heads 32 tightened against slot shoulder or shoulders 33. Slots 24 and 25 are laterally spaced apart, and extend longitudinally forwardly and rearwardly, in parallel relation.

FIG. 6 shows an alternate and preferred longitudinal adjustment configuration, incorporating two associated base plate sections 40 and 41, one carrying the pedestal unit 42, and the other carrying the pedal heel plate 43. Sections 40 and 41 are relatively movable, longitudinally, after loosening of fasteners 44, like fasteners 27 and 28. The fastener heads 44*a* slide in parallel slots, as at 46, in section 40, as the sections 40 and 41 are adjusted longitudinally, base sections 40 and 41 overlapping at 48. After such adjustment, the fasteners are tightened to clamp the overlapping sections together, in adjusted state, for selected positioning, lengthwise, and as best fits the drummer's foot positioning during drumming. Note the fastener shanks 44*b* retained in openings 49 in the upper section 41, and the screw heads 44*a* retained in the slots 46. Tapering of the heads enables clamping of the heads to the lower section 40, without protrusion below the base plate.

Referring back to FIG. 2, such relative adjustments at 23, forwardly and rearwardly, as of base plate or base plate sections, are enabled with or without heel height adjustment at 24; and heel height adjustment at 24 may be made without forward and/or rearward adjustment as at 23.

In FIGS. 4–6 heel pad or plate 50 is pivotally connected at 51 to the rearward end 52*a* of pivoted pedal 12. Pivot 51 may take various forms. Fasteners 54 connect the plate 50 to the rearwardmost extent of the base plate, for example section 41 in FIG. 5.

Height adjustment is enabled by provision of at least one removable plate positioned in stacked relation to the heel plate at the rearwardmost extent of the pedal; or positioned at a location proximate the base 41 and a pedal rearward section 12*a*. Section 12*a* is connected to plate 43, as by fastener or fasteners 62. Therefore, plate 43 may be regarded as functionally part of the pedal rearward section, or associated with the pedal rearward section, or may be regarded as a separate plate, or may be regarded as a pedal heel plate.

FIG. 7 shows two removable heel plates 43*a* and 43*b* that extend in superimposed relation, and that have upper and lower undulating surfaces 64, 65, 66, and 67. The undulations are formed by laterally extending ridges in two sets, as for example at 65*a* and 65*b*. Set 65*a* comprises two ridges, and set 65*b* comprises three ridges, and corresponding ridges are formed at each of the surfaces 64–67. Similar ridges are found at upper and lower surfaces of plate 43. Plate 43*a* is also thicker than plate 43*b*.

Figure 8A:
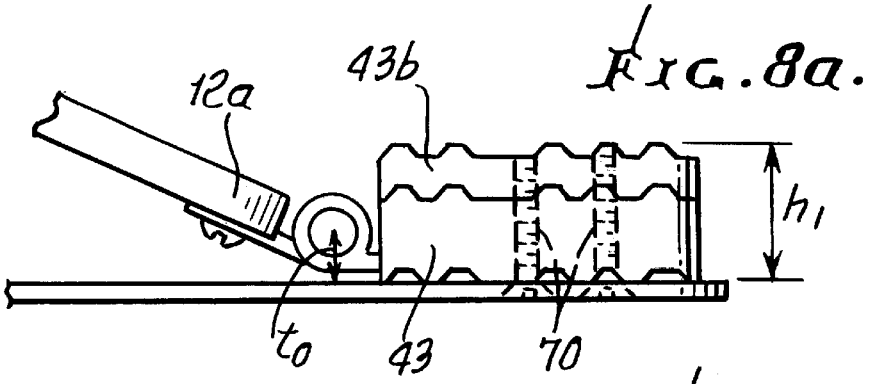
FIGS. 8*a*–8*h* are similar elevational views showing various height adjustment plate usages to achieve desired selective adjustment of the pedal heel end.
Figure 8B:
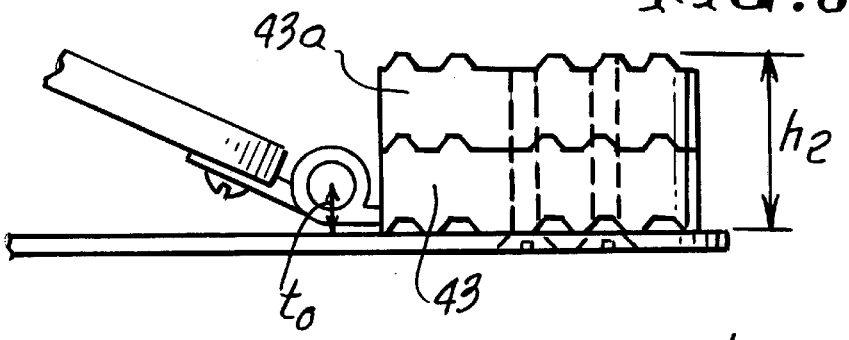

FIG. 8*a* shows plate 43*b* attached to the top of plate 43, with meshing undulations, to prevent relative slippage of the plates, longitudinally. Fasteners 70 interconnect the plates. Heel height (for the drummer's shoe heel) is indicated at $h_1$. In FIG. 8*b*, plate 43*a* is attached to the top of plate 43, as shown, to establish greater heel height $h_2$.

Figure 8C:
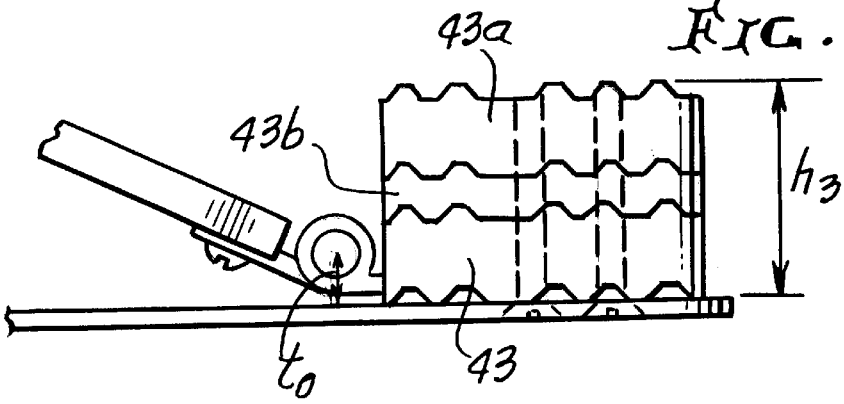

In FIG. 8*c* both plates 43*a* and 43*b* are attached to the top of plate 43, as shown, to establish heel height $h_3$.

Figure 8D:
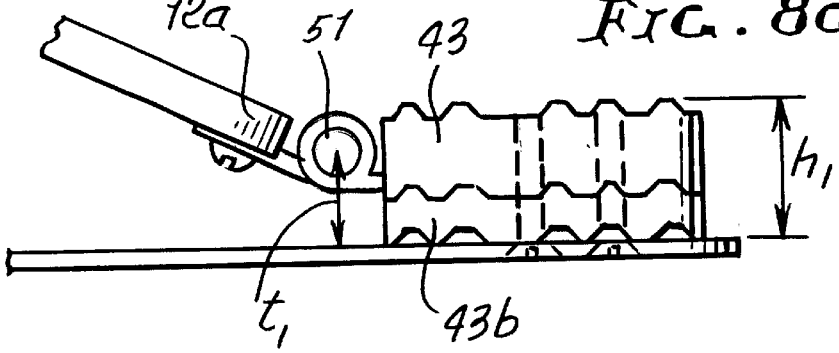
Figure 8E:
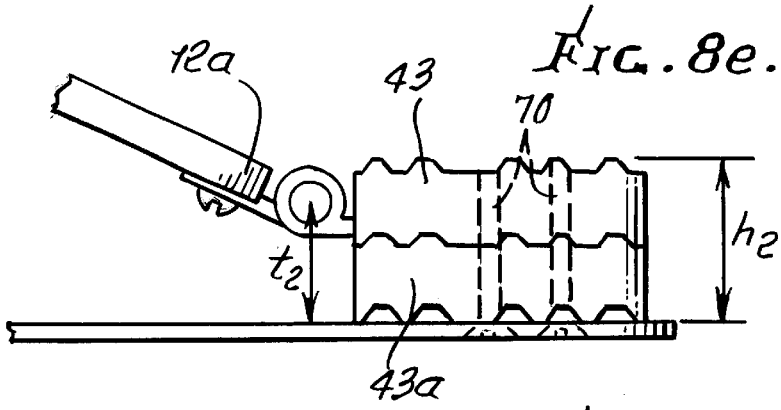
Figure 8F:
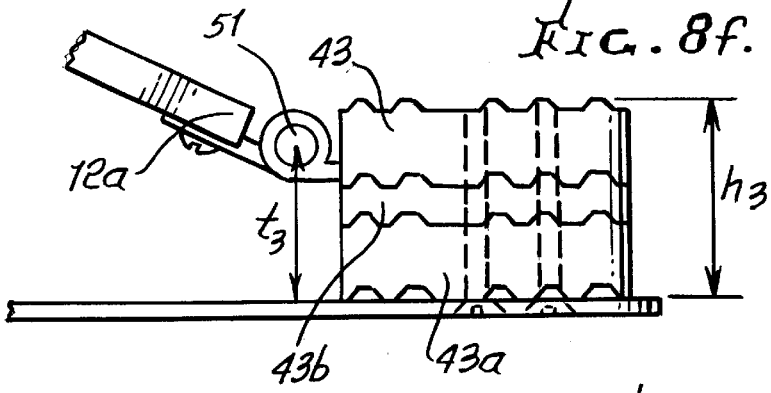

In FIG. 8*d*, plate 43*b* is attached to the underside of plate 43, as shown, to establish heel height $h_1$, but the rearward portion 12*a* of the pedal is now elevated, by elevation $t_1$ of the pivot. Pivot elevation in FIGS. 8*a*–8*c* is $t_o$. In FIG. 8*e*, plate 43*a* is attached to the underside of plate 43, to establish heel height $h_2$, but also to elevate the rearward portion of the pedal by elevation $t_2$ of the pivot. In FIG. 8*f*, both plates 43*a* and 43*b* are positioned beneath plate 43 to establish heel height $h_3$ but also to elevate the rearward portion 12*a* of the pedal by elevation $t_3$ of the pivot.

Figure 8G:
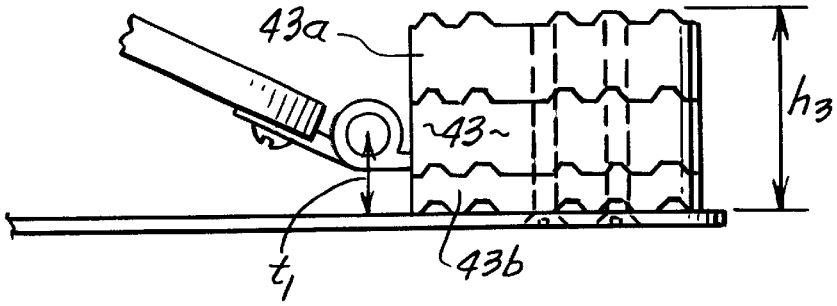
Figure 8H:
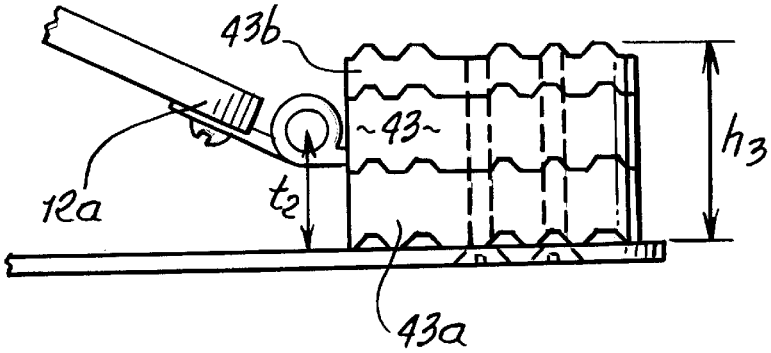

FIG. 8*g* is like FIG. 8*d*, but plate 43*a* is attached to the top of plate 43, to establish height $h_3$ and pivot elevation $t_1$; and FIG. 8*h* is like FIG. 8*e* but plate 43*b* is attached to the top of plate 43, to establish height $h_3$ and pivot elevation $t_2$.

In summary, the following are alternative possibilities using removable plates (i.e. in addition to FIG. 5 configuration):

FIG. 8*a* $t_o$ $h_1$
FIG. 8*b* $t_o$ $h_2$
FIG. 8*c* $t_o$ $h_3$
FIG. 8*d* $t_1$ $h_1$
FIG. 8*e* $t_2$ $h_2$
FIG. 8*f* $t_3$ $h_3$
FIG. 8*g* $t_1$ $h_3$
FIG. 8*h* $t_2$ $h_3$

I claim:

1. The combination incorporating an adjustable pedal unit, for beating a drum, comprising:

a) a base, b) a pedal having rearward connection to the base, at a heel region, to accommodate pedal pivoting, c) a pedestal unit carried by the base and spaced forwardly of said rearward connection, and a drum beater carried by the pedestal unit to be rotated in response to foot actuated pivoting of the pedal, d) there being an adjustment on the base whereby the relative positioning as between the pedestal and the pedal is selectively adjustable, e) said adjustment including at least two superimposed, relatively movable plates, positioned proximate the base, and pedal rearward extent, said plates characterized as providing pedal height adjustability.

2. The combination of claim 1 wherein said adjustment is between the pedestal unit rearwardmost extent of the base.

3. The combination of claim 1 wherein said adjustment includes elements associated with the pedestal unit and the base, said elements providing an adjustable connection.

4. The combination of claim 3 wherein said elements include at least one opening on one of the pedestal unit and base, and at least one fastener carried by the other of said pedestal units and base and projecting into said at least one opening.

5. The combination of claim 4 wherein said at least one opening includes at least one slot in the base.

6. The combination of claim 4 wherein said at least one opening includes at least two slots in the base, and extending in forward directions.

7. The combination of claim 1 wherein said adjustment is forward of said rearward connection.

8. The combination of claim 7 wherein said base has two associated sections which are relatively movable, and said adjustment is between said two sections.

9. The combination of claim 8 wherein said adjustment is forward of said rearward connection.

10. The combination of claim 8 wherein said base sections extend in overlapping relation.

11. The combination of claim 8 wherein said adjustment includes elements associated with said two sections, said elements providing an adjustable connection.

12. The combination of claim 11 wherein said elements include at least one fastener to fasten said sections in adjusted position.

13. The combination of claim 12 wherein said elements include at least one slot to receive said fastener, said slot located forwardly of said rearward connection.

14. The combination of claim 1 wherein said plates extend in stacked relation.

15. The combination of claim 14 wherein said plates include at least one removable plate positioned in stacked relation with a heel plate at the rearwardmost extent of the pedal.

16. The combination of claim 15 wherein the pedal has forward and rearward sections, and said removable plate is positioned at a location proximate the base and said pedal rearward section.

17. The combination of claim 16 including a pivot between said pedal forward and rearward sections, to allow up and down pivoting of said pedal relative to the base.

18. The combination of claim 16 including at least one removable fastener attaching said pedal rearward section and said at least one removable plate to the base.

19. The combination of claim 16 wherein there are at least two relatively superimposed and removable plates positioned at locations proximate the base and said pedal rearward section, said plates having different thicknesses.

20. The combination of claim 19 wherein said plates have undulant interengagement surfaces.

21. The combination of claim 19 including at least one fastener attaching said pedal rearward section, and said plates to the base.

22. The combination incorporating an adjustable pedal unit, for beating a drum, comprising:

a) a base, b) a pedal having rearward connection to the base, at a heel region, to accommodate pedal pivoting, c) a pedestal unit carried by the base and spaced forwardly of said rearward connection, and a drum beater carried by the pedestal unit to be rotated in response to foot actuated pivoting of the pedal, d) and including a height adjustment to adjust the height of pedal rearward extent relative to the base, e) said height adjustment including at least two superimposed, relatively movable plates, positioned proximate the base, and said pedal rearward extent, said plates characterized as providing height adjustability.

23. The combination of claim 22 wherein said plates are positioned in stacked relation.

24. The combination of claim 22 wherein the pedal has forward and rearward sections, said plates include at least one removable plate positioned at a location proximate the base and said pedal rearward section.

25. The combination of claim 24 including a pivot between said pedal forward and rearward sections, to allow up and down pivoting of said pedal relative to the base.

26. The combination of claim 24 including at least one removable fastener attaching said pedal rearward section and said at least one plate to the base.

27. The combination of claim 24 wherein said plates have different thicknesses.

28. The combination of claim 27 including at least one fastener attaching said pedal rearward section, and said plates to the base.

29. An adjustable pedal unit beating a drum, comprising in combination a) a base having relatively adjustably interconnected sections, b) a pedestal and beater carried by one of said sections, c) a pedal pivotable to effect beater displacement to beat a drum, d) and including a height adjustment to adjust the height of pedal rearward extent relative to the base, e) said height adjustment including at least two superimposed, relatively movable plates, positioned proximate the base, and said pedal rearward extent, said plates characterized as providing height adjustability.

* * * * *